US005322552A

United States Patent [19]

Dettke et al.

[11] Patent Number: 5,322,552

[45] Date of Patent: Jun. 21, 1994

[54] STABLE, ELECTROLESS, AQUEOUS, ACIDIC GOLD BATH FOR DEPOSITING GOLD AND THE USE THEREOF

[75] Inventors: Manfred Dettke; Robert Ruether; Klaus Janotta, all of Berlin, Fed. Rep. of Germany

[73] Assignee: Schering, AG, Fed. Rep. of Germany

[21] Appl. No.: 978,690

[22] PCT Filed: Aug. 1, 1991

[86] PCT No.: PCT/DE91/00624

§ 371 Date: Apr. 2, 1993

§ 102(e) Date: Apr. 2, 1993

[87] PCT Pub. No.: WO92/02663

PCT Pub. Date: Feb. 20, 1992

[30] Foreign Application Priority Data

Aug. 2, 1990 [DE] Fed. Rep. of Germany ..... 4024764

[51] Int. Cl.[5] ..... C23C 18/31

[52] U.S. Cl. ..... 106/1.23; 106/126

[58] Field of Search ..... 106/1.23, 1.26; 427/437

[56] References Cited

U.S. PATENT DOCUMENTS

| | | | |
|---|---|---|---|
| 4,374,876 | 2/1983 | El-Shazly et al. | 106/1.23 |
| 4,474,838 | 12/1984 | Halecky et al. | 106/1.23 |
| 4,830,668 | 5/1989 | Wundt et al. | 106/1.23 |
| 4,838,937 | 6/1989 | Oh | 106/1.23 |
| 4,919,720 | 4/1990 | Stavitsky | 106/1.23 |

FOREIGN PATENT DOCUMENTS 3614090 4/1987 Fed. Rep. of Germany .

*Primary Examiner*—Helene Klemanski
*Attorney, Agent, or Firm*—Paul & Paul

[57] ABSTRACT

Stable, electroless, aqueous acidic gold bath, containing the tetracyano-(III) anion, a complexing agent, or a mixture of several complexing agents, and an acid, or a mixture of acids, and the use of these baths for the deposition of gold on metals which are less noble than gold or on alloys of these metals.

9 Claims, No Drawings

STABLE, ELECTROLESS, AQUEOUS, ACIDIC GOLD BATH FOR DEPOSITING GOLD AND THE USE THEREOF

The invention relates to a stable, electroless, aqueous acidic gold bath for depositing gold and the use thereof. The bath, in accordance with the invention, containing the tetracyanogold(III) anion, a complexing agent or a mixture of several complexing agents and an acid or a mixture of acids, is suitable for the electroless deposition of gold on metals which are less noble than gold as well as on the alloys of these metals.

Gold baths for the electroless deposition of gold are already known, for example from documents such as DE patent specification 3640028, U.S. Pat. No. 4,830,668 and GB patent specification 20 99 460. These deal with gold baths which, for the most part, contain an alkali metal dicyanoaurate(I) or an alkali metal tetracyanoaurate(III), a complexing agent and a reducing agent. All of these baths have unsatisfactory stability, as a rule, and decompose with the deposition of metallic gold or gold(I) cyanide.

The present invention has the task of depositing gold from the tetracyanogold(III) on metals or their alloys in the acidic range and, at the same time, providing a more stable gold bath.

It has been found that the stability of the gold bath is increased when complexing agents or mixtures of several complexing agents are used which contain various groups per molecule which have a complexing and reducing effect. In this regard, we are dealing with such compounds that contain, per molecule, one or more carboxyl groups and one or more phosphonic acids groups. In particular, these are compounds of the general formula I and II as follows:

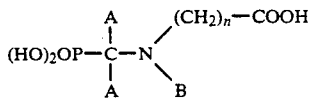

I whereby:

A=H, $-CH_3$, $-(CH_2)_n$ ——— $PO(OH)_2$,
B=H, $-(CH_2)_n$ ——— COOH, and
n=0 or 1-5

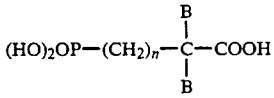

II whereby:

B=H, $-(CH_2)_n$ ——— COOH, and
n=0 or 1-5.

N,N-bis(carboxymethylene)-1-aminoethane-1,1-diphosphonic acid and 2-phosphonobutane-1,2,4-tricarboxylic acid have proven themselves valuable as complexing agents in the baths in accordance with the invention.

A special advantage of the bath in accordance with the invention is that layers up to 0.5 μm are obtained even with a gold content in the bath of 1.0 g/l of gold. As a result, the bath makes the gold plating of alloys possible, as is common in the semi-conductor industry, for example iron-nickel-cobalt alloys and nickel alloys that are coated reductively by chemical means, such as nickel-phosphorus and nickel-boron and super-pure nickel.

Surprisingly, it has also been found that the direct coating of tungsten is also possible, which leads to completely new layer structures in the chip carrier industry.

In accordance with the invention, the carboxymethyleneaminoalkylphosphonic acids and/or the phosphonoalkylcarboxylic acids are used as complexing agents which make a considerable increase in deposition speed possible as well as greater layer thicknesses, this being something which was not foreseen.

The acids used are, for example, sulfuric acid or phosphoric acid or their mixtures.

The basic composition of the bath in accordance with the invention is, for example, as follows:

| | |
|---|---|
| gold as metal | 0.05-30 grams/liter |
| complexing agent | 1-100 grams/liter |
| acids | 10-100 ml/liter |

The working temperature of the bath is, as a rule, 70° to 90° C. Even in the case of higher temperatures, it has been found that decomposition of the bath, e.g. sedimentation of elemental gold, does not take place. An additional advantage of the bath is that it can be used repeatedly and that the gold salt can be metered out subsequently as desired.

For layer thicknesses of up to 0.5 μm, the bath in accordance with the invention has a constant deposition speed, this being a function of its gold content and the temperature.

The bath in accordance with the invention can be used for the gold coating of soldered joints which are formed from crystal or wires bonds, this being something which is of particular value industrially.

The high deposition speed also makes utilization possible in the case of decorative gold plating. A uniform yellow layer can be observed after seconds.

Very uniform and ductile coatings can be deposited from the stable bath compositions, which are listed below, under the working conditions which are cited.

The invention also relates to the use of the gold baths in accordance with the invention for the deposition of gold on metals which are less noble than gold or on alloys of these metals.

EXAMPLE 1

| | |
|---|---|
| Potassium tetracyanoaurate(III) | 1.0 g/l |
| 2-phosphonobutane-1,2,4-tricarboxylic acid (complex) | 10 g/l |
| Sulfuric acid (D 1.84) | 20 ml/l |
| pH-value | less than 1 |
| Temperature | 90° C. |
| Deposition speed | 0.5 μm in 30 minutes |

EXAMPLE 2

| | |
|---|---|
| Potassium tetracyanoaurate(III) | 6.0 g/l |
| 2-phosphonobutane-1,2,4-tricarboxylic acid (complex) | 40.0 ml/l |
| Sulfuric acid/phosphoric acid 1:1 | 50.0 ml/l |
| pH-value | less than 1 |
| Temperature | 60° C. |
| Deposition speed | 0.2 μm/30 minutes |

Especially good adhesive strength

We claim:

1. Stable, electroless, aqueous, acidic gold bath, containing the tetracyanogold(III) anion, a complexing agent or a mixture of complexing agents and an acid or a mixture of acids, wherein the complexing agent comprises a compound which contains, per molecule of complexing agent, one or more carboxyl groups and one or more phosphonic acid groups.

2. Stable, electroless, aqueous, acidic gold bath, in accordance with claim 1, wherein the complexing agent contains at least one compound of general formula I:

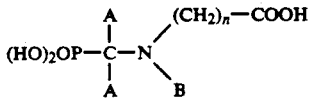

I whereby:

A=H, $-CH_3$, $-(CH_2)_n$———$PO(OH)_2$,

B=H, $-(CH_2)_n$———COOH, and n=0 or 1-5.

3. Stable, electroless, aqueous, acidic gold bath, in accordance with claim 1, wherein the complexing agent contains at least one compound of general formula II:

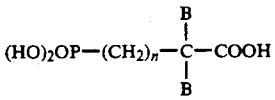

II whereby:

B=H, $-(CH_2)_n$———COOH, and n=0 or 1-5.

4. Gold bath in accordance with claim 1, containing N,N-bis (carboxymethylene)-1-aminoethane-1,1-diphosphonic acid, 2-phosphonobutane-1,2,4-tricarboxylic acid or mixtures thereof as complexing agents.

5. Stable, electroless, aqueous, acidic gold bath, in accordance with at least one of the claims 1-4, wherein the complexing agent, or the mixture of complexing agents, as a whole is contained in a concentration of 1-100 g/l.

6. Process for deposition of gold on a metal or metal alloy which is less noble than gold, the process comprising contacting the metal or metal alloy with a stable, electroless, aqueous, acidic gold bath, containing the tetracyanolgold(III) anion, a complexing agent or a mixture of complexing agents and an acid or a mixture of acids, wherein the complexing agent comprises a compound which contains, per molecule of complexing agent, one or more carboxyl groups and one or more phosphonic acid groups.

7. Process in accordance with claim 6, wherein the the complexing agent contains at least one compound of general formula I:

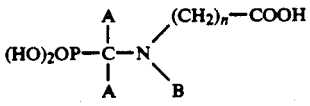

I whereby:

A=H, $-CH_3$, $-(CH_2)_n$———$PO(OH)_2$,

B=H, $-(CH_2)_n$———COOH, and n=0 or 1-5.

8. Process in accordance with claim 6, wherein the complexing agent contains at least one compound of the general formula II:

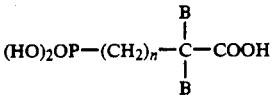

II whereby:

B=H, $-(CH_2)_n$———COOH, and n=0 or 1-5.

9. Process in accordance with claim 6, wherein the gold bath comprises N,N-bis(carboxymethylene)-1-aminoethane-1,1diphosphonic, 2-phosphonobutane-1,2,4-tricarboxylic acid or mixtures thereof as complexing agents.

* * * * *

UNITED STATES PATENT AND TRADEMARK OFFICE

CERTIFICATE OF CORRECTION

PATENT NO. : 5,322,552
DATED : June 21, 1994
INVENTOR(S) : Dettke et al.

It is certified that error appears in the above-indentified patent and that said Letters Patent is hereby corrected as shown below:

On title page, item [73] "Schering, AG" should be changed to --Atotech Deutschland GmbH--.

Signed and Sealed this

Sixth Day of September, 1994

*Attest:*

*Attesting Officer*

BRUCE LEHMAN

*Commissioner of Patents and Trademarks*